US011441293B2

(12) United States Patent
Stahle et al.

(10) Patent No.: US 11,441,293 B2
(45) Date of Patent: Sep. 13, 2022

(54) ADJUSTABLE RIDE CONTROL SYSTEM

(71) Applicant: DEERE & COMPANY, Moline, IL (US)

(72) Inventors: Scott R. Stahle, Dubuque, IA (US); Grant R. Henn, Dubuque, IA (US)

(73) Assignee: DEERE & COMPANY, Moline, IL (US)

( * ) Notice: Subject to any disclaimer, the term of this patent is extended or adjusted under 35 U.S.C. 154(b) by 355 days.

(21) Appl. No.: 16/670,219

(22) Filed: Oct. 31, 2019

(65) Prior Publication Data

US 2021/0131068 A1 May 6, 2021

(51) Int. Cl.

| | |
|---|---|
| ***E02F 9/22*** | (2006.01) |
| ***E02F 3/34*** | (2006.01) |
| ***E02F 3/43*** | (2006.01) |
| ***F15B 13/02*** | (2006.01) |
| ***E02F 9/20*** | (2006.01) |
| ***E02F 9/16*** | (2006.01) |
| ***E02F 9/24*** | (2006.01) |
| ***F15B 1/02*** | (2006.01) |
| ***E02F 9/08*** | (2006.01) |

(52) U.S. Cl.

CPC ..... *E02F 9/2228* (2013.01); *E02F 3/34* (2013.01); *E02F 3/431* (2013.01); *E02F 9/0883* (2013.01); *E02F 9/16* (2013.01); *E02F 9/2004* (2013.01); *E02F 9/2041* (2013.01); *E02F 9/2217* (2013.01); *E02F 9/2271* (2013.01); *E02F 9/24* (2013.01); *F15B 1/02* (2013.01); *F15B 13/022* (2013.01)

(58) Field of Classification Search

CPC ..... F15B 1/021; F15B 21/008; F15B 2211/8613; E02F 9/2207; E02F 9/2217; E02F 9/2228

See application file for complete search history.

(56) References Cited

U.S. PATENT DOCUMENTS 6,357,230 B1 * 3/2002 A'Hearn ..... E02F 9/2207 60/413
8,307,641 B2 11/2012 Hanks et al.
9,145,659 B2 * 9/2015 Walz ..... E02F 3/964
(Continued)

FOREIGN PATENT DOCUMENTS

EP 2843378 A1 3/2015

*Primary Examiner* — Abiy Teka
(74) *Attorney, Agent, or Firm* — Taft Stettinius & Hollister LLP; Stephen F. Rost

(57) ABSTRACT

An adjustable ride control circuit and method that includes a head valve that controls flow between a boom cylinder head intake and an accumulator, and a rod float valve that controls flow between a boom cylinder rod intake and tank, where the rod float valve is electronically adjustable and proportionally controls flow restriction. A controller controls ride control activation, and adjustment of the head and rod float valves. When ride control is activated, the head valve allows flow between the head intake and the accumulator, and the controller automatically adjusts the rod float valve. When ride control is deactivated, the head valve blocks flow between the head intake and the accumulator, and the rod float valve blocks flow between the rod intake and tank. An enable valve can control positioning of the head valve. A flow selector can select manual or automatic adjustment of the rod float valve.

18 Claims, 3 Drawing Sheets

(56) References Cited

U.S. PATENT DOCUMENTS

| | | | | |
|---|---|---|---|---|
| 10,053,838 | B2 | 8/2018 | Kean et al. | |
| 2006/0266027 | A1* | 11/2006 | Ma | E02F 9/2207 60/469 |
| 2013/0227937 | A1* | 9/2013 | Dobchuk | E02F 9/2217 60/327 |
| 2013/0299266 | A1 | 11/2013 | Ho et al. | |
| 2017/0130739 | A1 | 5/2017 | Zhang et al. | |
| 2018/0112375 | A1* | 4/2018 | Greer | E02F 3/3414 |

* cited by examiner

ADJUSTABLE RIDE CONTROL SYSTEM

FIELD OF THE DISCLOSURE

The present disclosure relates to hydraulic systems, and more particularly to a ride control system for a vehicle.

BACKGROUND

Various machines or vehicles, for example those equipped with a boom and work implement, may include a ride control system to improve the machine's ride over different types of terrain with either an empty or loaded work implement. Ride control systems can fluidly connect a hydraulic accumulator to a hydraulic cylinder that supports the boom. During movement of the machine, fluid can transfer between the cylinder and the accumulator allowing for movement of the boom relative to the rest of the machine. This type of arrangement can reduce rocking motion of the machine as the ride control will absorb some of the energy created by the inertial forces between the boom and the rest of the machine. This can provide increased productivity and operator comfort, and also reduce shock loads to the machine. In some situations, an operator may prefer a lot of boom movement which suggests a softer suspension of the boom, while in other situations an operator may prefer less boom movement which suggests a stiffer suspension of the boom.

It would be desirable for the ride control system to be adjustable either manually by an operator or automatically by a machine control system to provide softer or stiffer rides. The adjustment of the ride control system can be based on various monitored machine parameters.

SUMMARY

An adjustable ride control circuit is disclosed for a vehicle that includes a hydraulic source, a hydraulic accumulator, a hydraulic tank, a boom and a boom hydraulic cylinder. The boom hydraulic cylinder includes a head intake and a rod intake, and the boom hydraulic cylinder controls movement of the boom. The adjustable ride control circuit includes a head valve, an adjustable rod float valve, and a ride controller. The head valve is configured to control flow between the head intake of the boom hydraulic cylinder and the hydraulic accumulator. The adjustable rod float valve is configured to control flow between the rod intake of the boom hydraulic cylinder and the hydraulic tank. The adjustable rod float valve is an electronically adjustable valve that proportionally controls flow restriction between the rod intake and the hydraulic tank. The ride control controller is configured to receive control inputs, control activation of ride control, and control adjustment of the head valve and the adjustable rod float valve. When the ride control controller activates ride control, the head valve allows flow between the head intake of the boom hydraulic cylinder and the hydraulic accumulator, and the ride control controller automatically controls adjustment of the adjustable rod float valve to control flow between the rod intake of the boom hydraulic cylinder and the hydraulic tank. When the ride control controller deactivates ride control the head valve blocks flow between the head intake of the boom hydraulic cylinder and the hydraulic accumulator, and the adjustable rod float valve blocks flow between the rod intake of the boom hydraulic cylinder and the hydraulic tank.

The adjustable ride control circuit can include a ride control enable valve that is controlled by the ride control controller and is configured to control the head valve. When the ride control controller activates ride control, the ride control enable valve positions the head valve to allow flow between the head intake of the boom hydraulic cylinder and the hydraulic accumulator. When the ride control controller deactivates ride control, the ride control enable valve positions the head valve to block flow between the head intake of the boom hydraulic cylinder and the hydraulic accumulator.

The adjustable ride control circuit can include a ride control flow selector that has a manual position and an automatic position. When ride control is activated and the ride control flow selector is in the manual position, the ride control controller controls adjustment of the adjustable rod float valve based on operator manual inputs. When ride control is activated and the ride control flow selector is in the automatic position, the ride control controller automatically controls adjustment of the adjustable rod float valve based on one or more control inputs. The one or more control inputs can include vehicle ground speed readings that indicate ground speed of the vehicle, and when the ride control flow selector is in the automatic position the ride control controller can automatically control adjustment of the adjustable rod float valve based on the vehicle ground speed readings. The one or more control inputs can include implement type readings that indicate a type of implement attached to the boom of the vehicle, and when the ride control flow selector is in the automatic position the ride control controller can automatically control adjustment of the adjustable rod float valve based on the implement type readings. The one or more control inputs can include accelerometer readings that indicate movement of an operator cab or an operator seat, and when the ride control flow selector is in the automatic position the ride control controller can automatically control adjustment of the adjustable rod float valve based on the accelerometer readings. The one or more control inputs can include boom linkage sensor readings that indicate position and/or movement of the boom, and when the ride control flow selector is in the automatic position the ride control controller automatically control adjustment of the adjustable rod float valve based on the boom linkage sensor readings. The one or more control inputs can include boom pressure sensor readings that indicate pressure of the boom hydraulic cylinder, and when the ride control flow selector is in the automatic position the ride control controller automatically control adjustment of the adjustable rod float valve based on the boom pressure sensor readings.

A method is disclosed of adjusting a ride control circuit of a vehicle that includes a hydraulic source, a hydraulic accumulator, a hydraulic tank, a boom and a boom hydraulic cylinder with a head intake and a rod intake, where the boom hydraulic cylinder controls movement of the boom. The method includes positioning a head valve to control flow between the head intake of the boom hydraulic cylinder and the hydraulic accumulator, and adjusting an adjustable rod float valve to control flow between the rod intake of the boom hydraulic cylinder and the hydraulic tank. The adjustable rod float valve is an electronically adjustable valve that proportionally controls flow restriction between the rod intake and the hydraulic tank. The method also includes blocking flow through the head valve between the head intake of the boom hydraulic cylinder and the hydraulic accumulator when ride control is deactivated; blocking flow through the adjustable rod float valve between the rod intake of the boom hydraulic cylinder and the hydraulic tank when ride control is deactivated; and allowing flow through the head valve between the head intake of the boom hydraulic cylinder and the hydraulic accumulator when ride control is activated. The method further includes, enabling the ride control controller to automatically control adjustment of the adjustable rod float valve based on the control inputs to control flow between the rod intake of the boom hydraulic cylinder and the hydraulic tank when ride control is activated.

The method can include controlling a ride control enable valve to control the head valve such that when ride control is deactivated, adjusting the ride control enable valve to position the head valve to block flow between the head intake of the boom hydraulic cylinder and the hydraulic accumulator; and when ride control is activated, adjusting the ride control enable valve to position the head valve to allow flow between the head intake of the boom hydraulic cylinder and the hydraulic accumulator.

The method can include receiving selector signals from a ride control flow selector that includes a manual position and an automatic position. The method can also include, when ride control is activated and the selector signals indicate the ride control flow selector is in the manual position, enabling the ride control controller to control adjustment of the adjustable rod float valve based on operator manually inputs; and when ride control is activated and the selector signals indicate the ride control flow selector is in the automatic position, enabling the ride control controller to automatically control adjustment of the adjustable rod float valve based on one or more control inputs. The method can also include receiving vehicle ground speed readings that indicate ground speed of the vehicle, and when the ride control flow selector is in the automatic position, having the ride control controller automatically control adjustment of the adjustable rod float valve based on the vehicle ground speed readings. The method can also include receiving implement type readings that indicate a type of implement attached to the boom of the vehicle, and when the ride control flow selector is in the automatic position, having the ride control controller automatically control adjustment of the adjustable rod float valve based on the implement type readings. The method can also include receiving accelerometer readings that indicate movement of an operator cab or an operator seat; and when the ride control flow selector is in the automatic position, having the ride control controller automatically control adjustment of the adjustable rod float valve based on the accelerometer readings. The method can also include receiving boom linkage sensor readings that indicate position and/or movement of the boom of the vehicle; and when the ride control flow selector is in the automatic position, having the ride control controller automatically control adjustment of the adjustable rod float valve based on the boom linkage sensor readings. The method can also include receiving boom pressure sensor readings that indicate pressure of the boom hydraulic cylinder, and when the ride control flow selector is in the automatic position, having the ride control controller automatically control adjustment of the adjustable rod float valve based on the boom pressure sensor readings.

BRIEF DESCRIPTION OF THE DRAWINGS

The above-mentioned aspects of the present disclosure and the manner of obtaining them will become more apparent and the disclosure itself will be better understood by reference to the following description of the embodiments of the disclosure, taken in conjunction with the accompanying drawings, wherein.

Corresponding reference numerals are used to indicate corresponding parts throughout the several views.

DETAILED DESCRIPTION

The embodiments of the present disclosure described below are not intended to be exhaustive or to limit the disclosure to the precise forms in the following detailed description. Rather, the embodiments are chosen and described so that others skilled in the art may appreciate and understand the principles and practices of the present disclosure.

Figure 1:
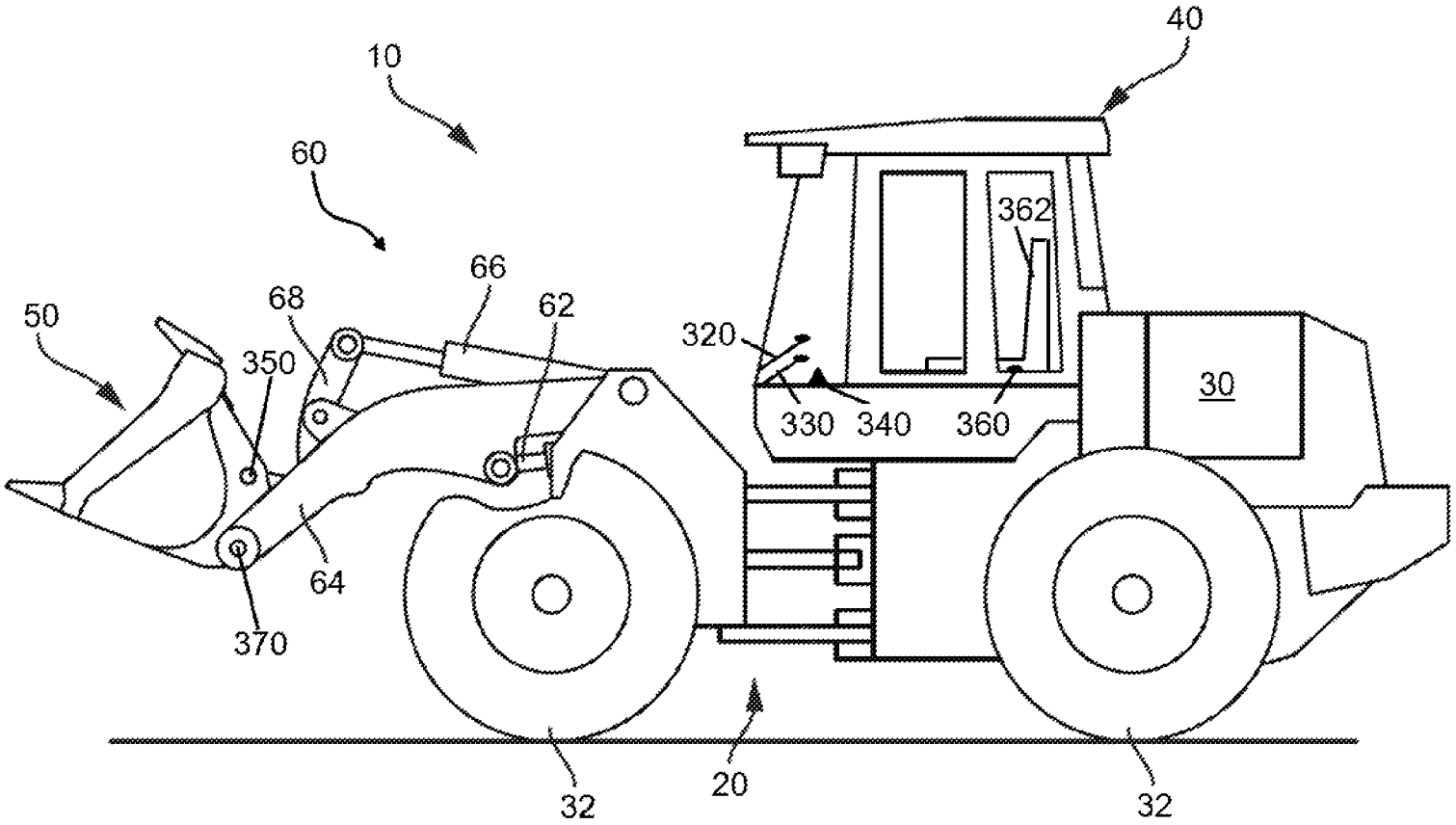
FIG. 1 illustrates an exemplary work machine that can include an adjustable ride control system.

FIG. 1 illustrates an exemplary work machine 10 that can include an adjustable ride control system. The work machine 10 can be a mobile machine that performs operations associated with construction, agriculture, forestry, transportation, mining or other industry. The work machine 10 can include a chassis 20 that supports a power source 30, an operator cab 40 a work implement 50 and boom 60. The power source 30 may be an engine such as, for example, a diesel, gasoline or other type of engine, that propels traction devices 32 for movement of the work machine 10. The work implement 50 can be movably attached to work machine 10 by the boom 60 which can include one or more boom cylinders 62, boom linkage 64, implement cylinders 66, implement linkage 68.

Figure 2:
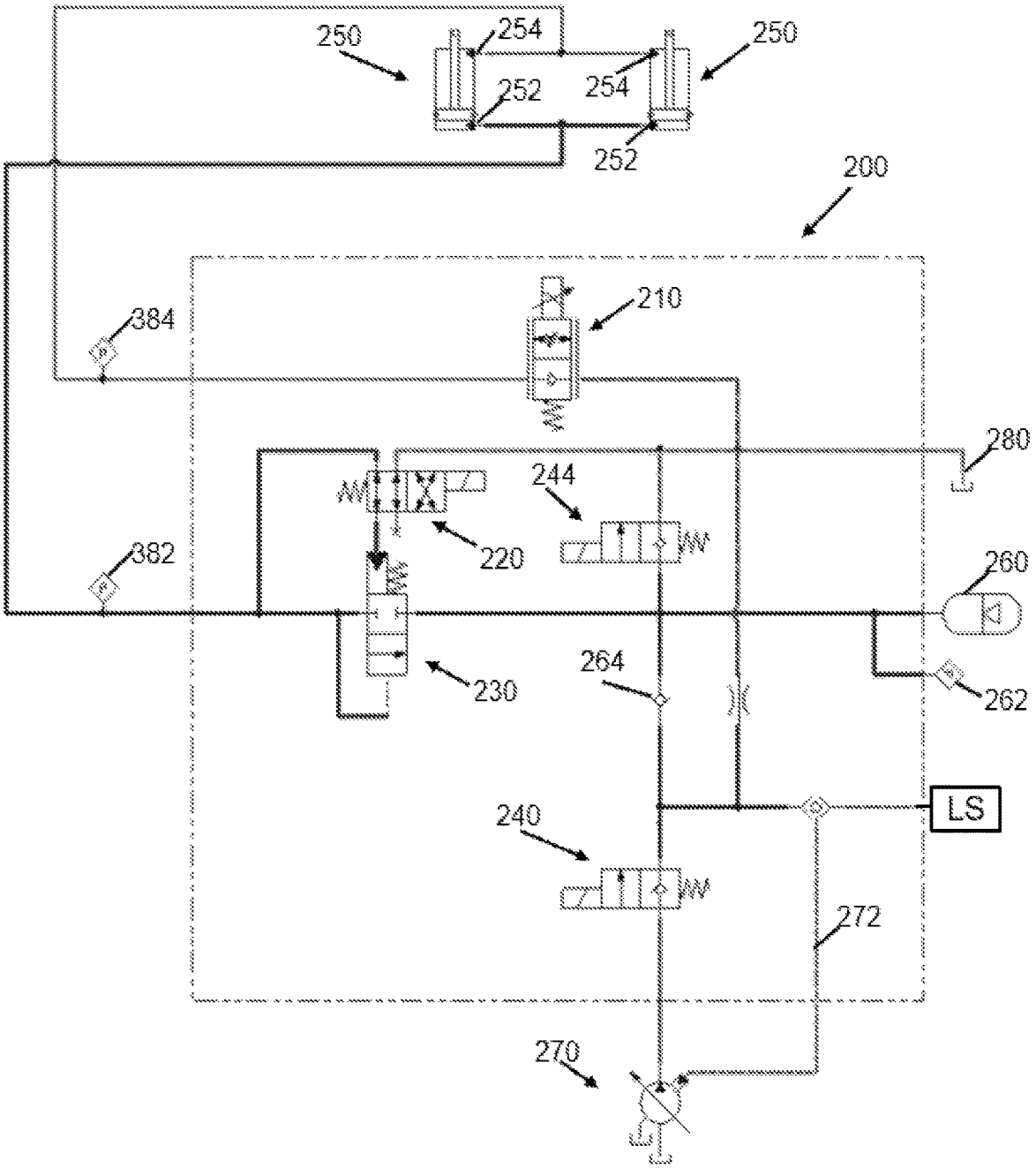
FIG. 2 illustrates a ride control hydraulic circuit that controls flow to and from one or more boom hydraulic cylinders.

FIG. 2 illustrates a ride control hydraulic circuit 200 that controls flow to and from one or more boom hydraulic cylinders 250. Each boom cylinder 250 includes a head intake 252 and a rod intake 254. The ride control hydraulic circuit 200 couples the boom cylinders 250 to an accumulator 260, a hydraulic source 270, and a tank or fluid reservoir 280. The hydraulic source 270 can be the main hydraulic system of the vehicle. A load sense line 272 can be used to monitor the status of the ride control circuit 200. The ride control circuit 200 includes a rod float valve 210, a ride control enable valve 220, a head valve 230, an accumulator charge valve 240 and an accumulator lower valve 244.

The head intake 252 of the boom hydraulic cylinder 250 is coupled to the accumulator 260 through the head valve 230 which is controlled by the ride control enable valve 220. The rod intake 254 of the boom cylinder 250 is coupled to the tank 280 through the rod float valve 210. The accumulator 260 is coupled to the source 270 through the accumulator charge valve 240, and the accumulator 260 is coupled to the tank 280 through the accumulator lower valve 244. An accumulator pressure sensor 262 monitors pressure in the accumulator 260. When pressure in the accumulator 260 is too low, the accumulator charge valve 240 is enabled to allow flow from the hydraulic source 270 to the accumulator 260 to increase pressure in the accumulator 260. A check valve 264 allows flow from the hydraulic source 270 to the ride control circuit 200 and prevents flow from the ride control circuit 200 to the hydraulic source 270. When pressure in the accumulator 260 is too high, the accumulator lower valve 244 is enabled to allow flow from the accumulator 260 to the tank 280 to decrease pressure in the accumulator 260.

The ride control enable valve 220 is biased to disable the ride control system by moving the head valve 230 to block flow between the head intake 252 and the accumulator 260. When the ride control enable valve 220 is activated to enable the ride control system, the ride control enable valve 220 moves the head valve 230 to allow free flow between the head intake 252 and the accumulator 260. This allows the boom cylinder 250 and attached implement 50 to move independently of the main chassis 20, like suspension on a car, to provide an improved ride for the operator.

In existing ride control systems, the rod float valve 210 is typically a simple on/off valve to either allow free flow between the rod intake 254 of the boom cylinder 250 and the tank 280, or have a fixed restriction of flow between the rod intake 254 of the boom cylinder 250 and the tank 280. Some operators/operations would prefer a lot of boom movement which suggests a free flow between the rod intake 254 and the tank 280 to create a softer suspension of the boom. Other operators/operations would prefer less boom movement and fewer oscillations of the boom which suggests a more restricted flow between the rod intake 254 and the tank 280 to create a stiffer suspension of the boom.

FIG. 2 illustrates the rod float valve 210 as an electronically adjustable valve that can proportionally control the restriction on flow between the rod intake 254 and the tank 280 with a variable orifice. This can enable the operator and/or a control system to tune the ride to be stiffer or softer by adjusting how much the boom 60 moves by restricting flow on the head side of the boom cylinders 62 with the rod float valve 210. This manual or automatic adjustment allows greater control for a softer ride during certain situations like transport and a stiffer ride during certain situations like truck loading based on control inputs. A ride control flow selector can be used by an operator to select manual or automatic control of the restriction on flow between the rod intake 254 and the tank 280 through the electronically adjustable rod float valve 210.

Figure 3:
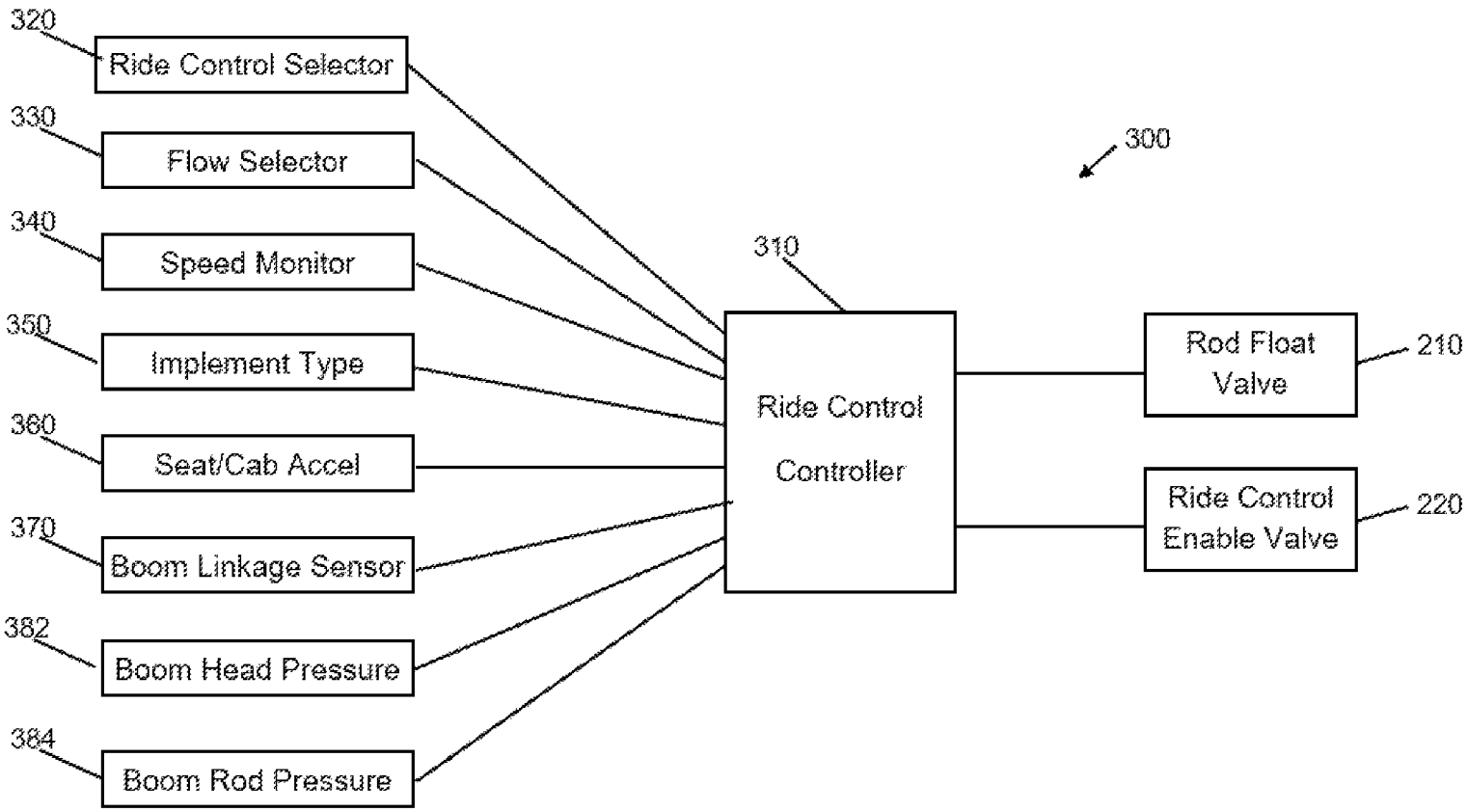
FIG. 3 illustrates a control system for the ride control system that can manually or automatically adjust the ride to be stiffer or softer by adjusting the control signal going to the rod float valve of the ride control circuit.

FIG. 3 illustrates a control system 300 for the ride control system 200 that can tune the ride to be stiffer or softer by adjusting the control signal going to the rod float valve 210. The control system 300 includes a ride control controller 310 that receives various control inputs and sends control outputs to the ride control enable valve 220, and to the rod float valve 210 to control restriction of flow through the rod float valve 210 between the rod intake 254 of the boom cylinder 250 and the tank 280. The ride control controller 310 can receive control inputs from a ride control selector 320, an operator flow selector 330, a vehicle ground speed monitor 340, an implement type sensor 350, an operator seat/cab accelerometer 360, boom linkage sensors 370, boom cylinder head pressure sensor 382, and boom cylinder rod pressure sensor 384.

The ride control selector 320 and operator flow selector 330 can be operator controls in the cab 40. The ride control selector 320 can have settings of off (ride control deactivated), and on (ride control activated). The operator flow selector 330 can have settings of off, manual (operator adjustment) and automatic (controller adjustment). When the ride control selector 320 is in the off position, the ride control controller 310 can disable the ride control system by turning off the enable valve 220 to move the head valve 230 to block flow between the head intake 252 and the accumulator 260, and by turning off the rod float valve 210 to block flow between the rod intake 254 and the tank 280. When the ride control selector 320 is in the on position, then the ride control controller 310 can control the ride control enable valve 220 to enable the ride control system by moving the head valve 230 to allow flow between the head intake 252 and the accumulator 260. When the ride control selector 320 is in the on position, the ride control controller 310 can also control restriction of flow through the rod float valve 210 between the rod intake 254 and the tank 280 based on the position of the operator flow selector 330. When the operator flow selector 330 is in the manual position, the operator can manually tune the ride to be stiffer or softer by adjusting the control signal going to the rod float valve 210. The operator flow selector 330 can have continuous or preselected restriction settings over a range from open to highly restricted to control flow through the rod float valve 210. When the operator flow selector 330 is in the automatic position, the ride control controller 310 can control restriction of flow through the rod float valve 210 between the rod intake 254 and the tank 280 automatically based on other control inputs, for example as described below.

The ride control controller 310 can automatically control restriction of flow through the rod float valve 210 based on vehicle ground speed readings from the vehicle ground speed monitor 340. For example, the ride control controller 310 can increase flow restriction for a stiffer ride as vehicle speed decreases, and decrease flow restriction for a softer ride as vehicle speed increases. The ride control controller 310 can automatically control restriction of flow through the rod float valve 210 based on implement type readings which indicate what type of attachment that is attached to the boom. The implement type readings can come from the implement type sensor 350, or be selectable by the operator through a machine interface, or be generated in another way. For example, the ride control controller 310 can decrease flow restriction for a softer ride with a bucket, and can increase flow restriction for a stiffer ride with forks for more precise control of the attachment. The ride control controller 310 can automatically control restriction of flow through the rod float valve 210 based on accelerometer readings from the operator seat/cab accelerometer 360 which can be attached to the cab 40 or an operator seat 362 to indicate bouncing of the cab 40 or operator seat 362. For example, the ride control controller 310 can increase flow restriction for a stiffer ride when the accelerometer readings indicate the cab 40 and/or seat 362 are bouncing more than a bounce threshold. The ride control controller 310 can automatically control restriction of flow through the rod float valve 210 based on height and/or movement readings from the boom linkage sensors 370 which can be attached to the boom linkage 64 to indicate position and/or movement of the boom 60. For example, the ride control controller 310 can increase flow restriction for a stiffer ride when the boom 60 is raised or is moving, and decrease flow restriction for a softer ride when the boom 60 is lowered or is not moving. The ride control controller 310 can automatically control restriction of flow through the rod float valve 210 based on implement load readings from the boom cylinder head and rod pressure sensors 382, 384 which indicate pressure of the boom cylinder 250 which changes with its load. For example, the ride control controller 310 can increase flow restriction for a stiffer ride as the load increases, and decrease flow restriction for a softer ride as the load decreases.

While the disclosure has been illustrated and described in detail in the drawings and foregoing description, such illustration and description is to be considered as exemplary and not restrictive in character, it being understood that illustrative embodiment(s) have been shown and described and that all changes and modifications that come within the spirit of the disclosure are desired to be protected. It will be noted that alternative embodiments of the present disclosure may not include all of the features described yet still benefit from at least some of the advantages of such features. Those of ordinary skill in the art may readily devise their own implementations that incorporate one or more of the features of the present disclosure and fall within the spirit and scope of the present invention as defined by the appended claims.

We claim:

1. An adjustable ride control circuit for a vehicle that includes a hydraulic source, a hydraulic accumulator, a hydraulic tank, a boom and a boom hydraulic cylinder with a head intake and a rod intake, where the boom hydraulic cylinder controls movement of the boom, the adjustable ride control circuit comprising:

a head valve configured to control flow between the head intake of the boom hydraulic cylinder and the hydraulic accumulator;

an adjustable rod float valve configured to control flow between the rod intake of the boom hydraulic cylinder and the hydraulic tank, the adjustable rod float valve is an electronically adjustable valve that proportionally controls flow restriction between the rod intake and the hydraulic tank;

a ride control controller configured to receive control inputs, control activation of ride control, and control adjustment of the head valve and the adjustable rod float valve; and a ride control flow selector having a manual position and an automatic position;

wherein when the ride control controller activates ride control, the head valve allows flow between the head intake of the boom hydraulic cylinder and the hydraulic accumulator, and the ride control controller automatically controls adjustment of the adjustable rod float valve to control flow between the rod intake of the boom hydraulic cylinder and the hydraulic tank; and wherein when the ride control controller deactivates ride control the head valve blocks flow between the head intake of the boom hydraulic cylinder and the hydraulic accumulator, and the adjustable rod float valve blocks flow between the rod intake of the boom hydraulic cylinder and the hydraulic tank; and wherein when ride control is activated and the ride control flow selector is in the manual position, the ride control controller controls adjustment of the adjustable rod float valve based on operator manual inputs, and when ride control is activated and the ride control flow selector is in the automatic position, the ride control controller automatically controls adjustment of the adjustable rod float valve based on one or more control inputs.

2. The adjustable ride control circuit of claim 1, further comprising a ride control enable valve controlled by the ride control controller and configured to control the head valve;

wherein when the ride control controller activates ride control, the ride control enable valve positions the head valve to allow flow between the head intake of the boom hydraulic cylinder and the hydraulic accumulator, and when the ride control controller deactivates ride control, the ride control enable valve positions the head valve to block flow between the head intake of the boom hydraulic cylinder and the hydraulic accumulator.

3. The adjustable ride control circuit of claim 1, wherein the one or more control inputs include vehicle ground speed readings that indicate ground speed of the vehicle, and when the ride control flow selector is in the automatic position the ride control controller automatically controls adjustment of the adjustable rod float valve based on the vehicle ground speed readings.

4. The adjustable ride control circuit of claim 1, wherein the one or more control inputs include implement type readings that indicate a type of implement attached to the boom of the vehicle, and when the ride control flow selector is in the automatic position the ride control controller automatically controls adjustment of the adjustable rod float valve based on the implement type readings.

5. The adjustable ride control circuit of claim 1, where the vehicle further includes an operator cab; and wherein the one or more control inputs include accelerometer readings that indicate movement of the operator cab, and when the ride control flow selector is in the automatic position the ride control controller automatically controls adjustment of the adjustable rod float valve based on the accelerometer readings.

6. The adjustable ride control circuit of claim 1, where the vehicle further includes an operator seat; and wherein the one or more control inputs include accelerometer readings that indicate movement of the operator seat, and when the ride control flow selector is in the automatic position the ride control controller automatically controls adjustment of the adjustable rod float valve based on the accelerometer readings.

7. The adjustable ride control circuit of claim 1, where the vehicle further includes boom linkage that moves with the boom of the vehicle; and wherein the one or more control inputs include boom linkage sensor readings that indicate a position of the boom, and when the ride control flow selector is in the automatic position the ride control controller automatically controls adjustment of the adjustable rod float valve based on the boom linkage sensor readings.

8. The adjustable ride control circuit of claim 1, where the vehicle further includes boom linkage that moves with the boom of the vehicle; and wherein the one or more control inputs include boom linkage sensor readings that indicate movement of the boom, and when the ride control flow selector is in the automatic position the ride control controller automatically controls adjustment of the adjustable rod float valve based on the boom linkage sensor readings.

9. The adjustable ride control circuit of claim 1, wherein the one or more control inputs include boom head pressure sensor readings that indicate pressure at the head intake of the boom hydraulic cylinder, and when the ride control flow selector is in the automatic position the ride control controller automatically controls adjustment of the adjustable rod float valve based on the boom head pressure sensor readings.

10. The adjustable ride control circuit of claim 1, wherein the one or more control inputs include boom rod pressure sensor readings that indicate pressure at the rod intake of the boom hydraulic cylinder, and when the ride control flow selector is in the automatic position the ride control controller automatically controls adjustment of the adjustable rod float valve based on the boom rod pressure sensor readings.

11. A method of adjusting a ride control circuit of a vehicle that includes a hydraulic source, a hydraulic accumulator, a hydraulic tank, a boom and a boom hydraulic cylinder with a head intake and a rod intake, where the boom hydraulic cylinder controls movement of the boom, the method comprising:

positioning a head valve to control flow between the head intake of the boom hydraulic cylinder and the hydraulic accumulator;

adjusting an adjustable rod float valve to control flow between the rod intake of the boom hydraulic cylinder and the hydraulic tank, the adjustable rod float valve being an electronically adjustable valve that proportionally controls flow restriction between the rod intake and the hydraulic tank;

controlling activation of ride control using a ride control controller configured to receive control inputs, and control adjustment of the head valve and the adjustable rod float valve;

blocking flow through the head valve between the head intake of the boom hydraulic cylinder and the hydraulic accumulator when ride control is deactivated;

blocking flow through the adjustable rod float valve between the rod intake of the boom hydraulic cylinder and the hydraulic tank when ride control is deactivated;

allowing flow through the head valve between the head intake of the boom hydraulic cylinder and the hydraulic accumulator when ride control is activated;

enabling the ride control controller to automatically control adjustment of the adjustable rod float valve based on the control inputs to control flow between the rod intake of the boom hydraulic cylinder and the hydraulic tank when ride control is activated;

receiving selector signals from a ride control flow selector that includes a manual position and an automatic position;

when ride control is activated and the selector signals indicate the ride control flow selector is in the manual position, enabling the ride control controller to control adjustment of the adjustable rod float valve based on operator manually inputs; and when ride control is activated and the selector signals indicate the ride control flow selector is in the automatic position, enabling the ride control controller to automatically control adjustment of the adjustable rod float valve based on one or more control inputs.

12. The method of claim 11, further comprising:

controlling a ride control enable valve to control the head valve;

when ride control is deactivated, adjusting the ride control enable valve to position the head valve to block flow between the head intake of the boom hydraulic cylinder and the hydraulic accumulator; and when ride control is activated, adjusting the ride control enable valve to position the head valve to allow flow between the head intake of the boom hydraulic cylinder and the hydraulic accumulator.

13. The method of claim 11, further comprising:

receiving vehicle ground speed readings that indicate ground speed of the vehicle; and when the ride control flow selector is in the automatic position, having the ride control controller automatically control adjustment of the adjustable rod float valve based on the vehicle ground speed readings.

14. The method of claim 11, further comprising:

receiving implement type readings that indicate a type of implement attached to the boom of the vehicle; and when the ride control flow selector is in the automatic position, having the ride control controller automatically control adjustment of the adjustable rod float valve based on the implement type readings.

15. The method of claim 11, further comprising:

receiving accelerometer readings that indicate movement of an operator cab or an operator seat of the vehicle; and when the ride control flow selector is in the automatic position, having the ride control controller automatically control adjustment of the adjustable rod float valve based on the accelerometer readings.

16. The method of claim 11, further comprising:

receiving boom linkage sensor readings that indicate a position of the boom of the vehicle; and when the ride control flow selector is in the automatic position, having the ride control controller automatically control adjustment of the adjustable rod float valve based on the boom linkage sensor readings.

17. The method of claim 11, further comprising:

receiving boom linkage sensor readings that indicate movement of the boom of the vehicle; and when the ride control flow selector is in the automatic position, having the ride control controller automatically control adjustment of the adjustable rod float valve based on the boom linkage sensor readings.

18. The method of claim 11, further comprising:

receiving boom pressure sensor readings that indicate pressure of the boom hydraulic cylinder; and when the ride control flow selector is in the automatic position, having the ride control controller automatically control adjustment of the adjustable rod float valve based on the boom pressure sensor readings.

* * * * *